US005370502A

United States Patent [19]

Haavik et al.

[11] Patent Number: 5,370,502

[45] Date of Patent: * Dec. 6, 1994

[54] LIQUID RING PUMPS WITH PRESSURIZED GAS SUPPORTED ROTATING LINERS

[75] Inventors: Harold K. Haavik, Norwalk, Conn.; Kaj Holm, Espoo, Finland

[73] Assignee: The Nash Engineering Company, Trumbull, Conn.

[ * ] Notice: The portion of the term of this patent subsequent to Mar. 22, 2011 has been disclaimed.

[21] Appl. No.: 169,585

[22] Filed: Dec. 17, 1993

Related U.S. Application Data

[63] Continuation of Ser. No. 4,448, Jan. 14, 1993, Pat. No. 5,295,794.

[51] Int. Cl.[5] ..... F04C 19/00

[52] U.S. Cl. ..... 417/68

[58] Field of Search ..... 417/68, 69

[56] References Cited

FOREIGN PATENT DOCUMENTS 686937 1/1940 Germany .

*Primary Examiner*—Richard A. Bertsch
*Assistant Examiner*—Roland G. McAndrews, Jr.
*Attorney, Agent, or Firm*—Robert R. Jackson

[57] ABSTRACT

Liquid ring pumps with rotating liners supported by a bearing fluid (pressurized liquid or compressed gas) have a bearing fluid distribution system that compensates for the radially unsymmetric load on the rotating liner. If the liner bearing fluid is compressed gas, the axial ends of the liner may be either open and unsealed so that expended bearing gas escapes into the liquid ring in the pump, or the axial ends of the Liner may be partly closed by radially inwardly extending end plates. Various mechanical and/or liquid seal structures may be used in conjunction with the end plates to seal the axial ends of the liner and/or to flush the clearances adjacent the axial ends of the liner.

13 Claims, 16 Drawing Sheets

LIQUID RING PUMPS WITH PRESSURIZED GAS SUPPORTED ROTATING LINERS

This is a continuation of application Ser. No. 08/004,448, filed Jan. 14, 1993 now U.S. Pat. No. 5,295,794.

BACKGROUND OF THE INVENTION

This invention relates to liquid ring pumps for pumping gases or vapors (hereinafter generically "gas") to compress the gas or to produce a reduced gas pressure region ("vacuum"). More particularly, the invention relates to liquid ring pumps having a liner inside the stationary pump housing, said liner being free to rotate with the liquid ring to thereby reduce fluid friction between the liquid ring and the housing.

Liquid ring pumps with rotating liners are known as shown, for example, by Haavik U.S. Pat. No. 5,100,300 and Russian patent 939,826. In Haavik U.S. Pat. No. 5,100,300 the liner is supported for rotation by a pressurized bearing liquid in the clearance between the liner and the stationary housing. In Russian patent 939,826 gas is mixed with the liquid which supports the liner for rotation to reduce frictional resistance to rotation of the liner.

In liquid ring pumps the pressure of the gas being pumped increases as it progresses around the pump. As a result, there is a substantial net force acting in one radial direction on any rotating liner provided in the pump. This net force tends to push the liner toward undesirable contact with the housing at a location along the above-mentioned radial direction. The system for supplying the pressurized bearing fluid for supporting the liner must be effective to substantially prevent such contact without requiring wastefully large bearing fluid flow rates and/or pressures.

It is therefore an object of this invention to improve the supply of bearing fluid to liquid ring pumps having rotating liners supported by such bearing fluid.

As has been mentioned, Russian patent 939,826 shows that rotating liner bearing liquid friction can be reduced by mixing gas with the bearing liquid. The fluid frictional drag on the rotating liner can be reduced even more by completely or substantially completely substituting compressed gas for liquid as the rotating liner bearing fluid. However, there are several concerns associated with using compressed gas instead of liquid as the bearing fluid. One such concern is that if gas is to be used, the clearance between the liner and the stationary housing should generally be smaller than if liquid is used. A smaller clearance exacerbates the above-mentioned problem of possible contact between the liner and the housing in the radial direction of net gas pressure force. Another concern associated with using gas as the liner bearing fluid is that if the clearance between the liner and the housing is sized for gas, then liquid should be kept out of that clearance to the greatest extent possible to avoid the high drag that liquid in such a small clearance would produce. It may also be important to prevent or substantially prevent the liner bearing gas from escaping into the working space of the pump, particularly into the intake region of a pump operating as a vacuum pump. Such escaping liner bearing gas wastes energy and reduces the volumetric efficiency of the pump. It is also generally desirable to operate the pump with the smallest amount and pressure of liner bearing fluid (whether liquid or gas) that can be made to give satisfactory results so that energy is not wasted pumping excessive amounts of bearing fluid or pumping the bearing fluid to unnecessarily high pressure.

In view of the foregoing, it is another object of this invention to improve liquid ring pumps with fluid-supported rotating liners.

It is still another object of this invention to provide liquid ring pumps in which compressed gas can be more readily used as a bearing fluid for the liner.

SUMMARY OF THE INVENTION

These and other objects of the invention are accomplished in accordance with the principles of the invention by providing liquid ring pumps having rotating liners which can be supported by compressed gas if desired. In order to reduce the risk that the rotating liner may contact the housing (e.g., on the high pressure or "compression" side of the pump), more of the liner bearing fluid (whether pressurized liquid or compressed gas) may be introduced per unit of liner surface area into the clearance between the liner and the housing on the compression side of the pump than is introduced into that clearance elsewhere. This can be accomplished, for example, by increasing the number of bearing fluid inlets on the compression side of the pump, by reducing the spacing between adjacent bearing fluid inlets on the compression side of the pump, and/or by providing larger bearing fluid inlets on the compression side of the pump.

To help keep liner bearing gas separate from the liquid used in the pump (e.g., as pumping and/or sealing liquid), the hollow cylindrical liner may be provided with at least one closed or partly closed end. Preferably the liner has two such ends. Various techniques may be used in conjunction with these closed or partly closed ends for removing expended liner bearing gas from the pump and/or for sealing the pump against escape of expended liner bearing gas into the working space of the pump. The presence of a rotating liner, especially a liner supported by gas and therefore rotating at a speed which is relatively close to the speed of the rotor tips, may allow the angle of inclination of the rotor blades to be decreased substantially from the typical prior art angle of inclination.

Further features of the invention, its nature and various advantages will be more apparent from the accompanying drawings and the following detailed description of the preferred embodiments.

Figure 7:
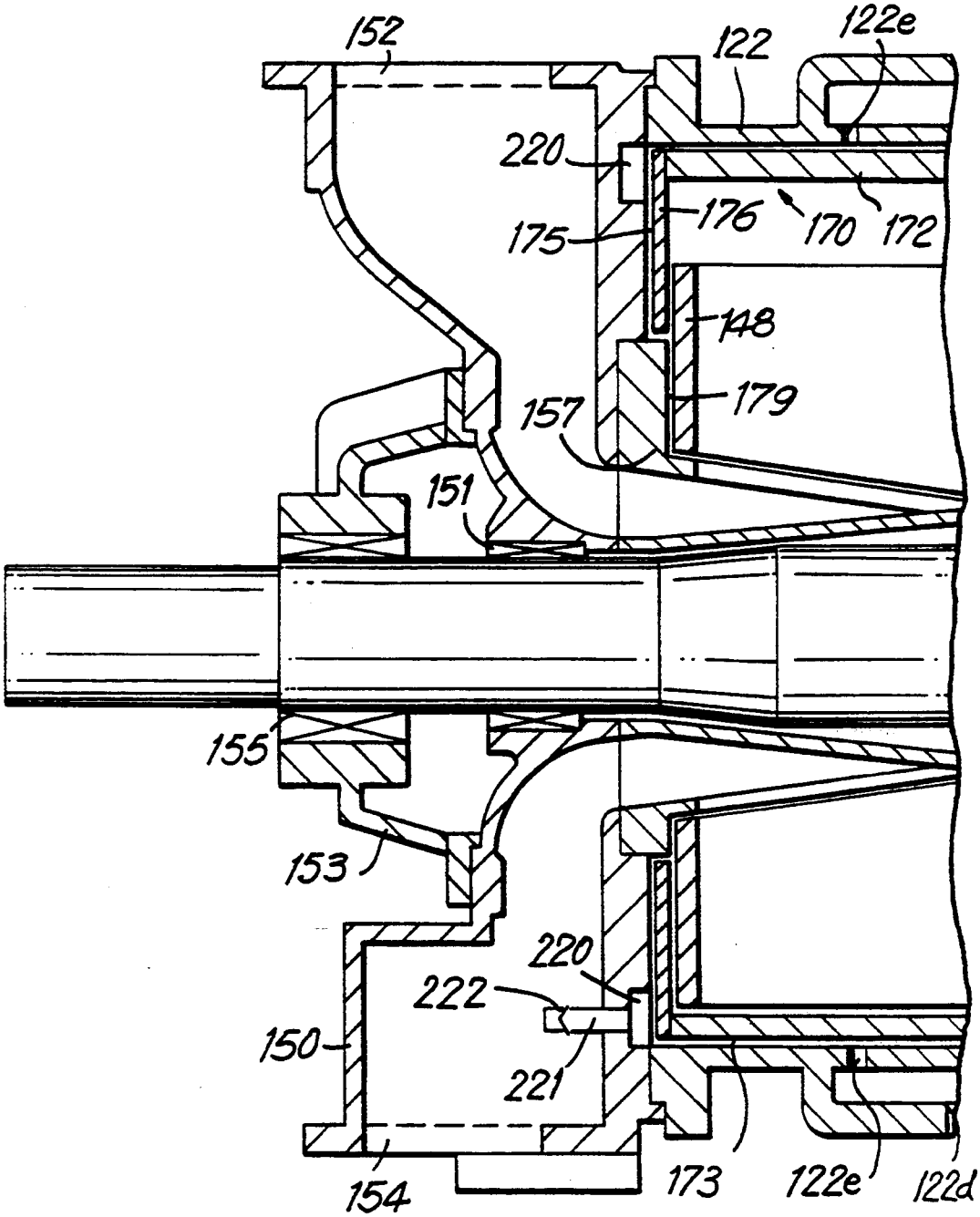
FIG. 7 is an enlargement of a portion of FIG. 6 showing a possible modification in accordance with this invention.

PIG. 8 is another view similar to FIG. 7 showing another possible modification in accordance with this invention.

Figure 9:
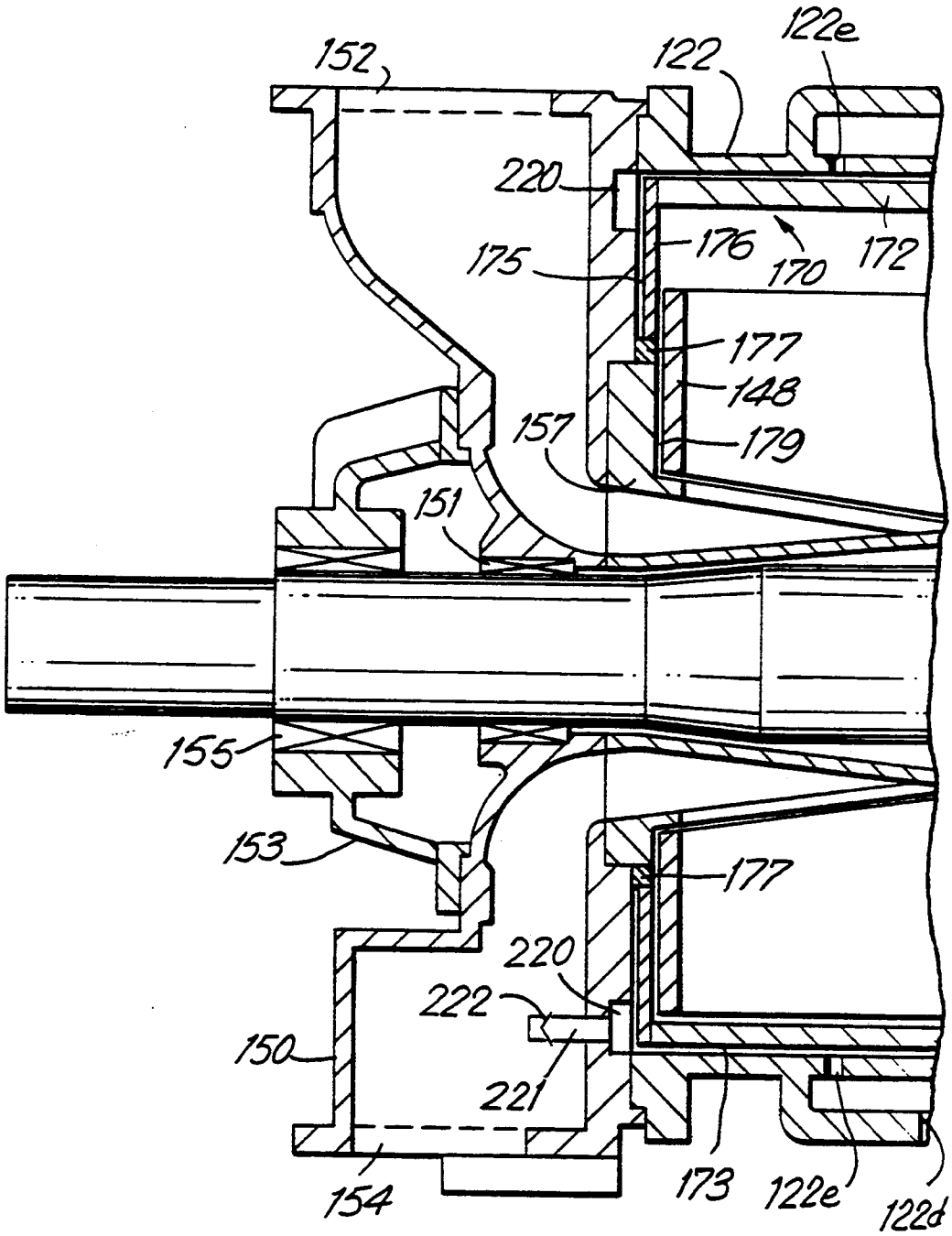

FIG. 9 is another view similar to FIG. 7 showing still another possible modification in accordance with this invention.

Figure 10:
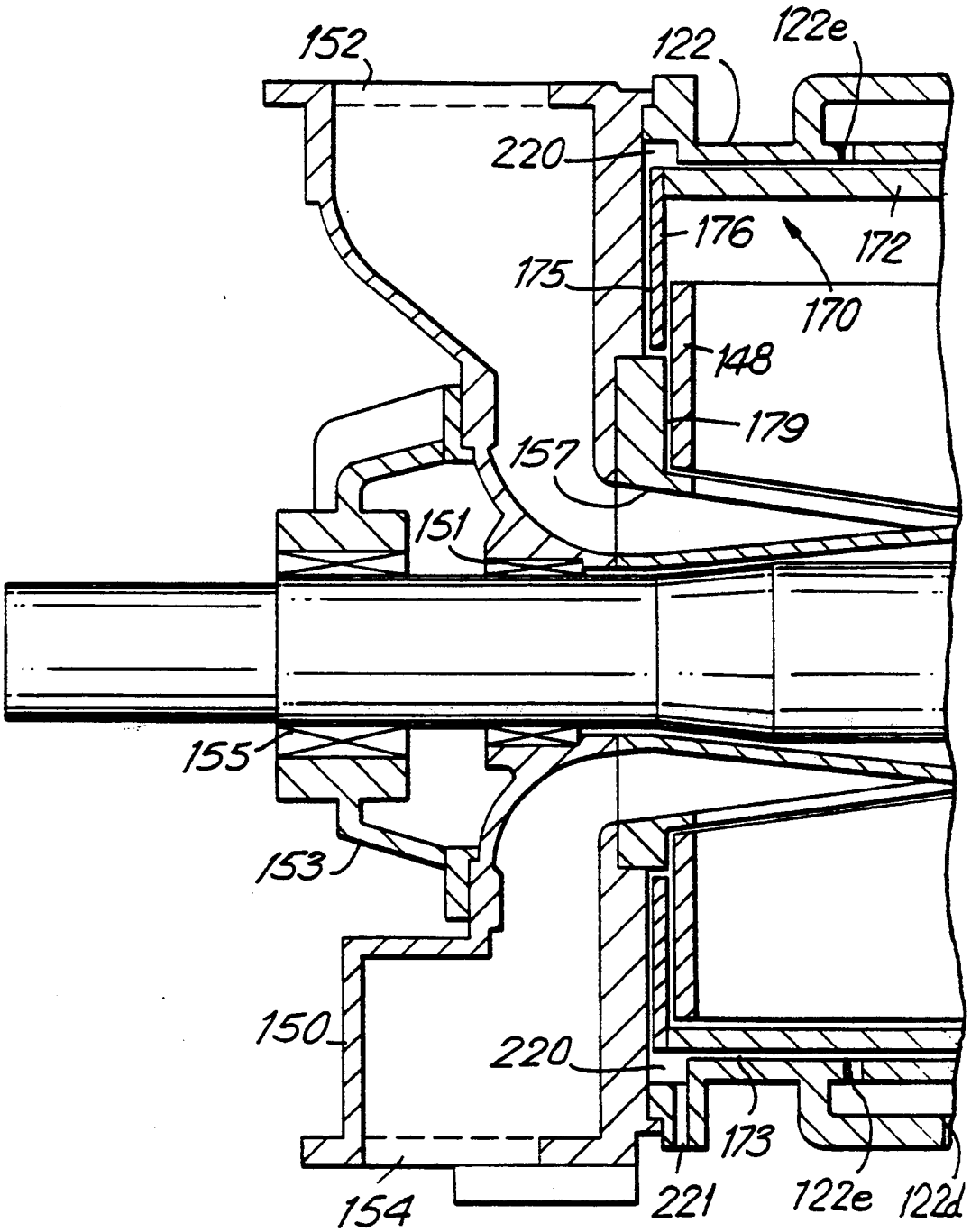

FIG. 10 is yet another view similar to FIG. 7 showing yet another possible modification in accordance with this invention.

Figure 11:
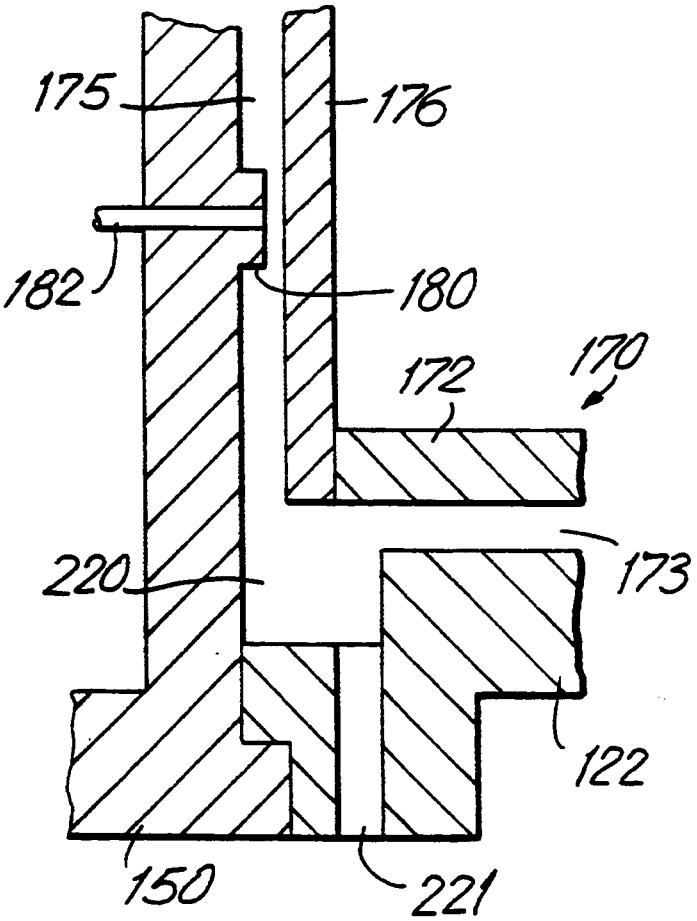

FIG. 11 is a view similar to a portion of FIG. 10 showing another possible modification in accordance with this invention.

Figure 12:
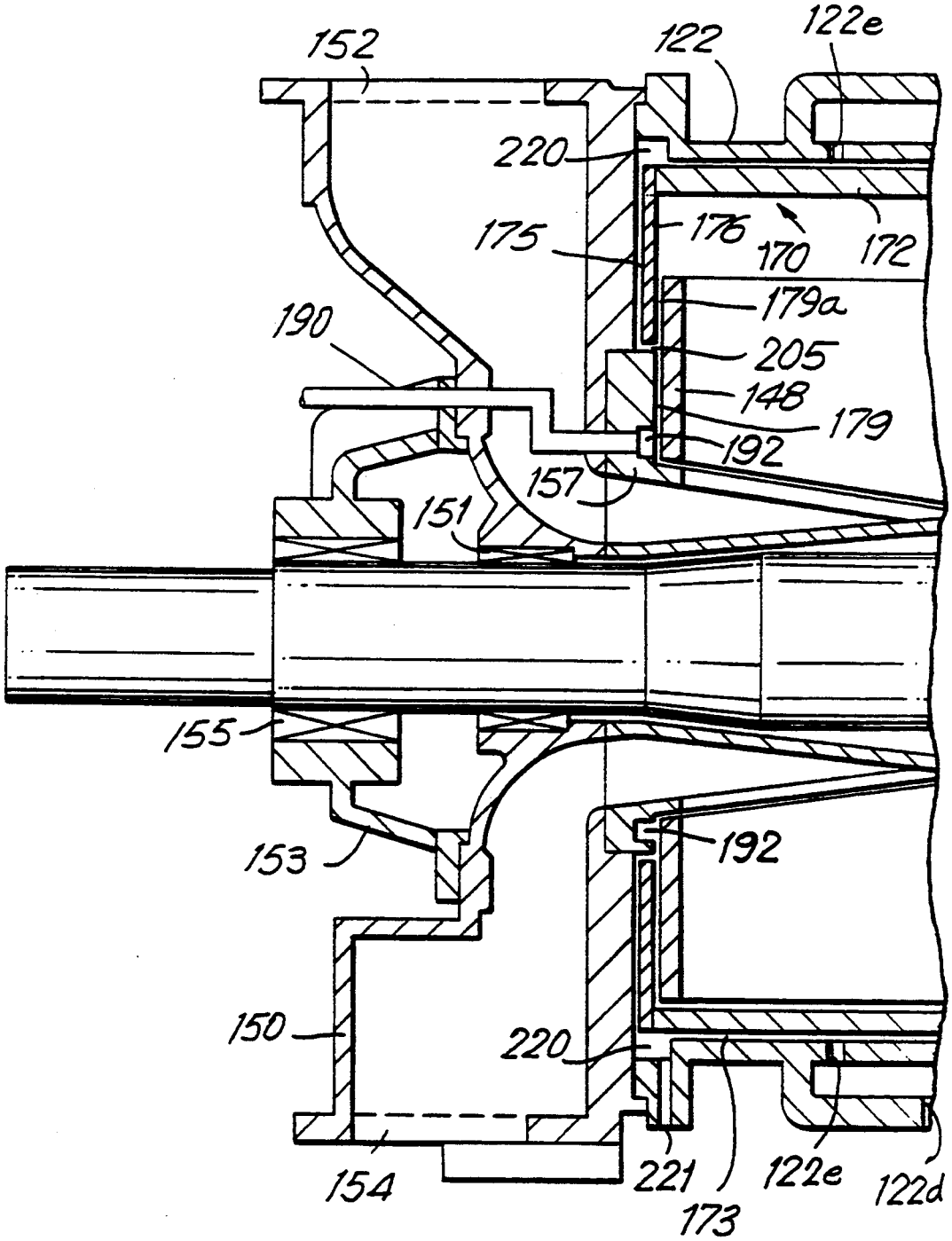

FIG. 12 is another view similar to FIG. 10 showing still another possible modification in accordance with this invention.

Figure 13:
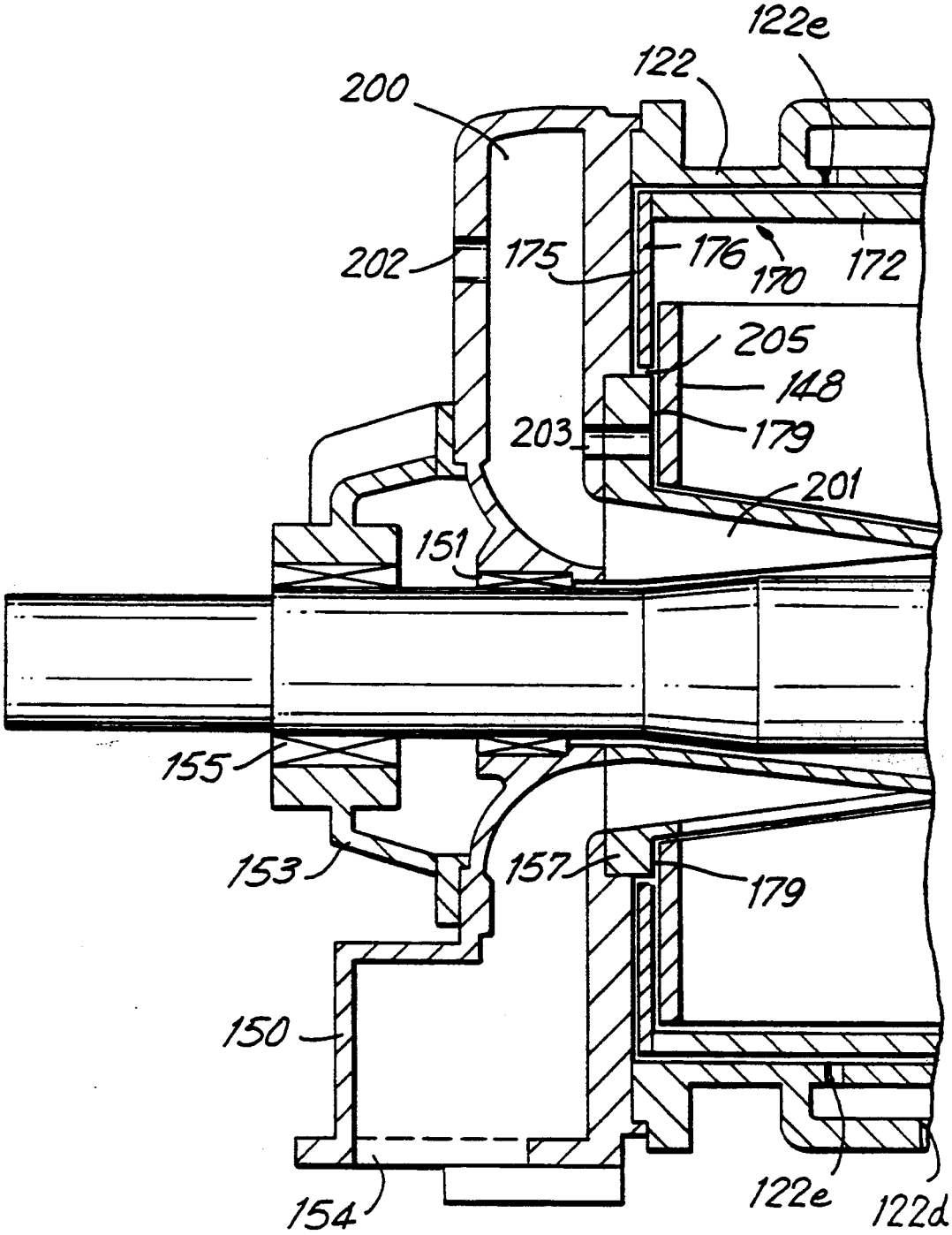

FIG. 13 is another view which is generally similar to FIG. 10 showing an alterative embodiment of the feature of this invention shown in FIG. 12.

Figure 14:
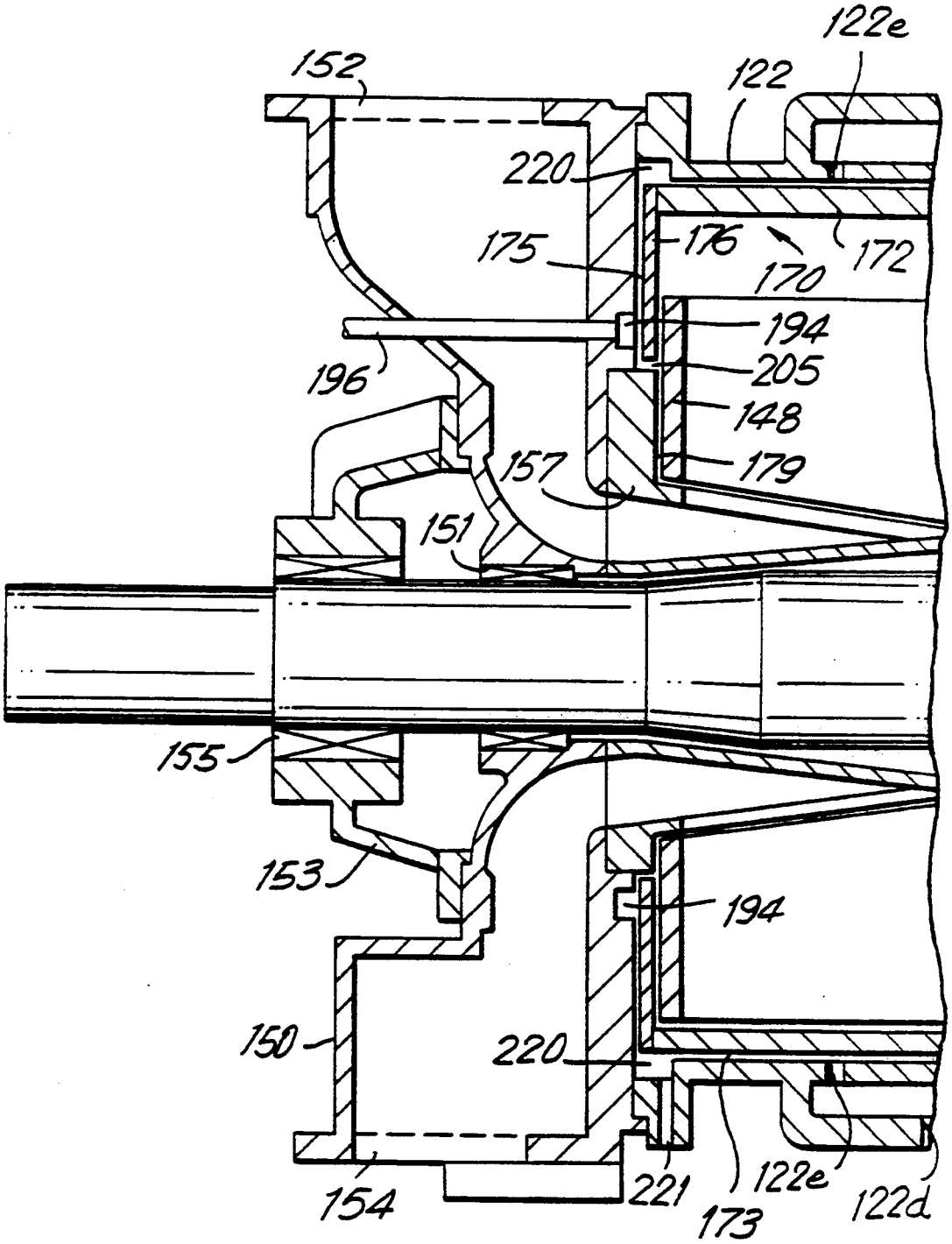

FIG. 14 is another view similar to FIG. 10 showing yet another possible modification in accordance with this invention.

Figure 15:
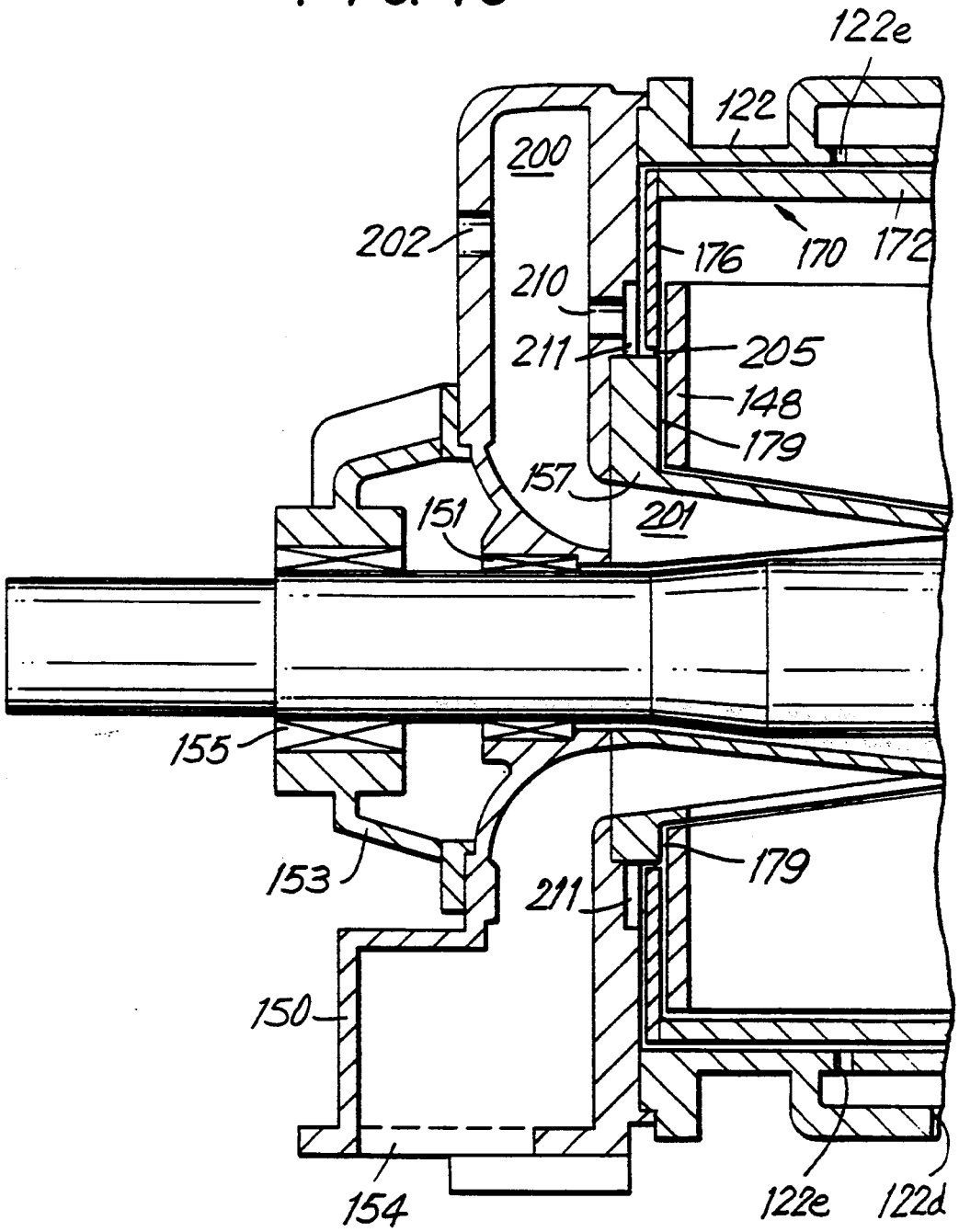

FIG. 15 is another view which is generally similar to FIG. 10 showing an alternative embodiment of the feature of this invention shown in FIG. 14.

Figure 16:
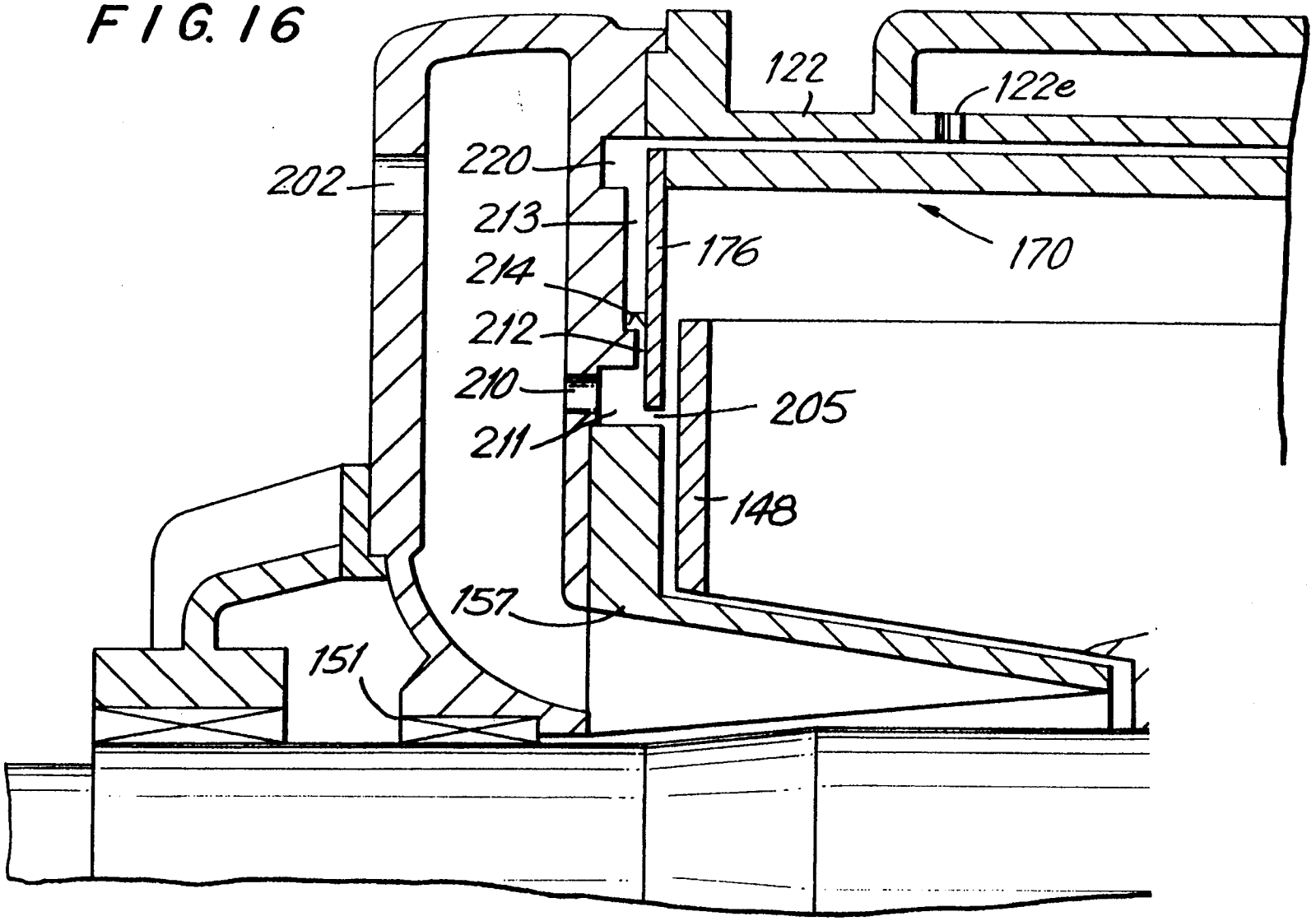

FIG. 16 is a view similar to a portion of FIG. 15 showing another possible modification in accordance with this invention.

Figure 17:
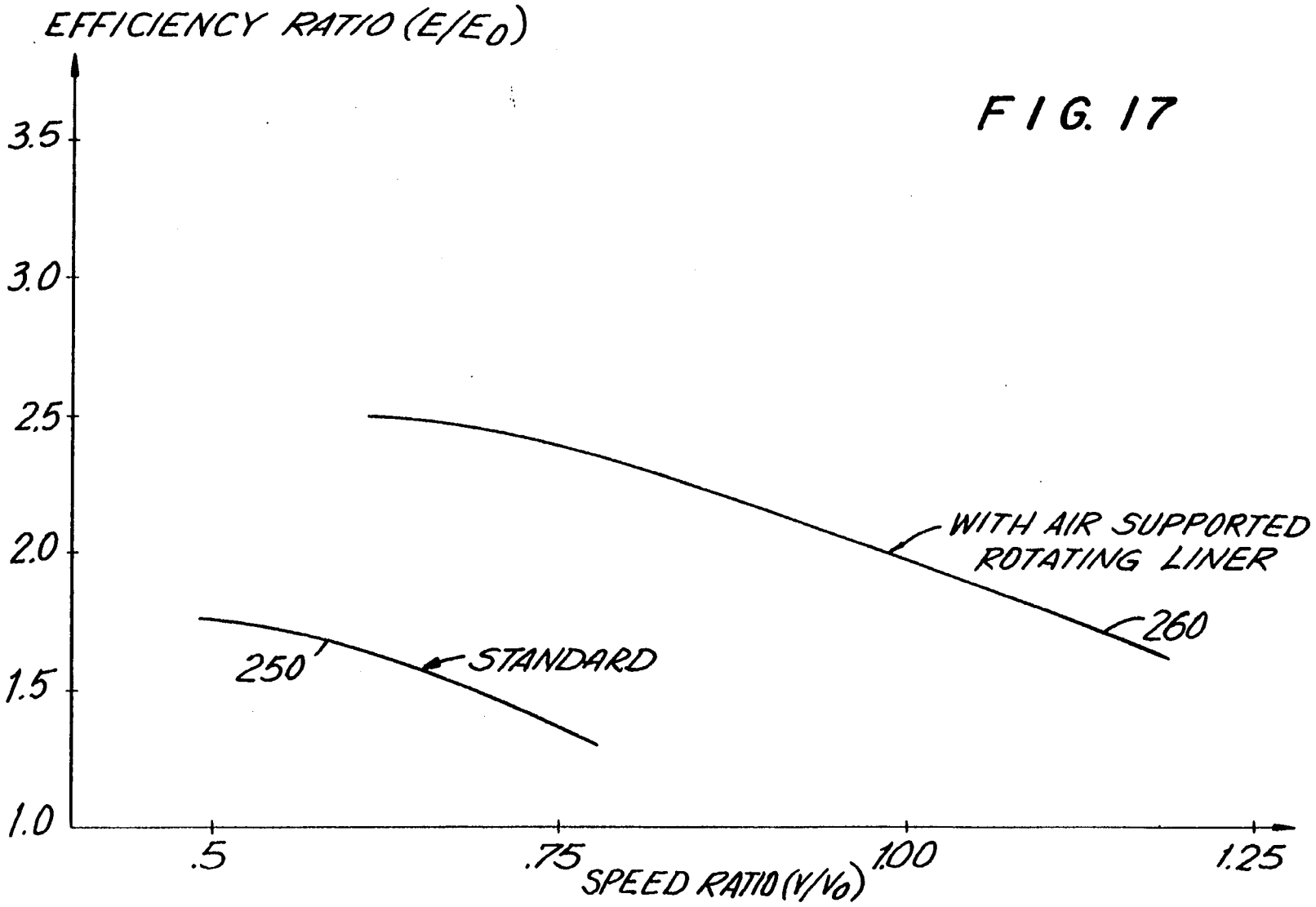

FIG. 17 is a comparative pump performance diagram useful in explaining some of the advantages of certain aspects of this invention.

Figure 1:
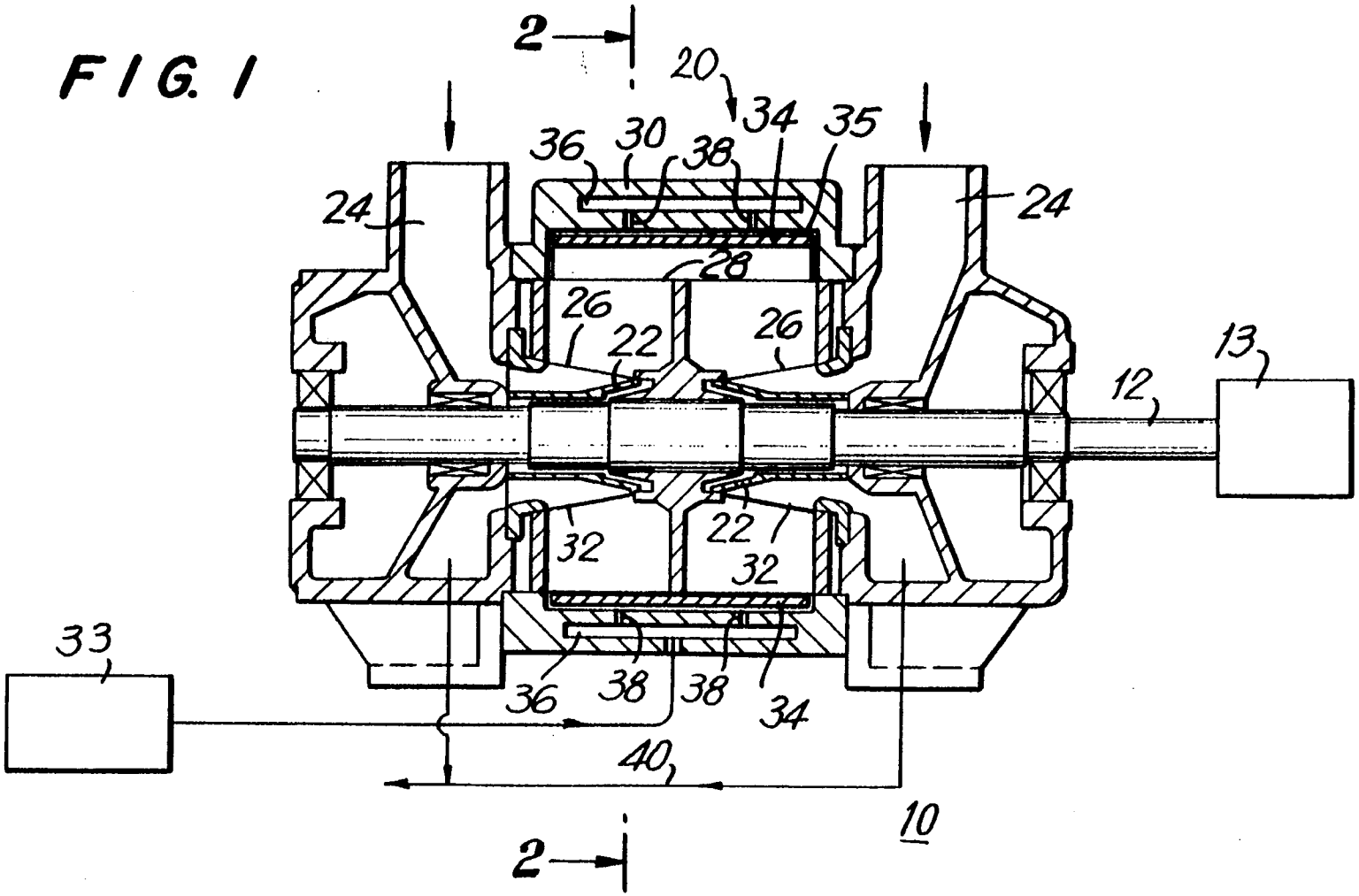
FIG. 1 is a simplified sectional view of an illustrative liquid ring pump which can be constructed and/or operated in accordance with the principles of this invention.
Figure 18:
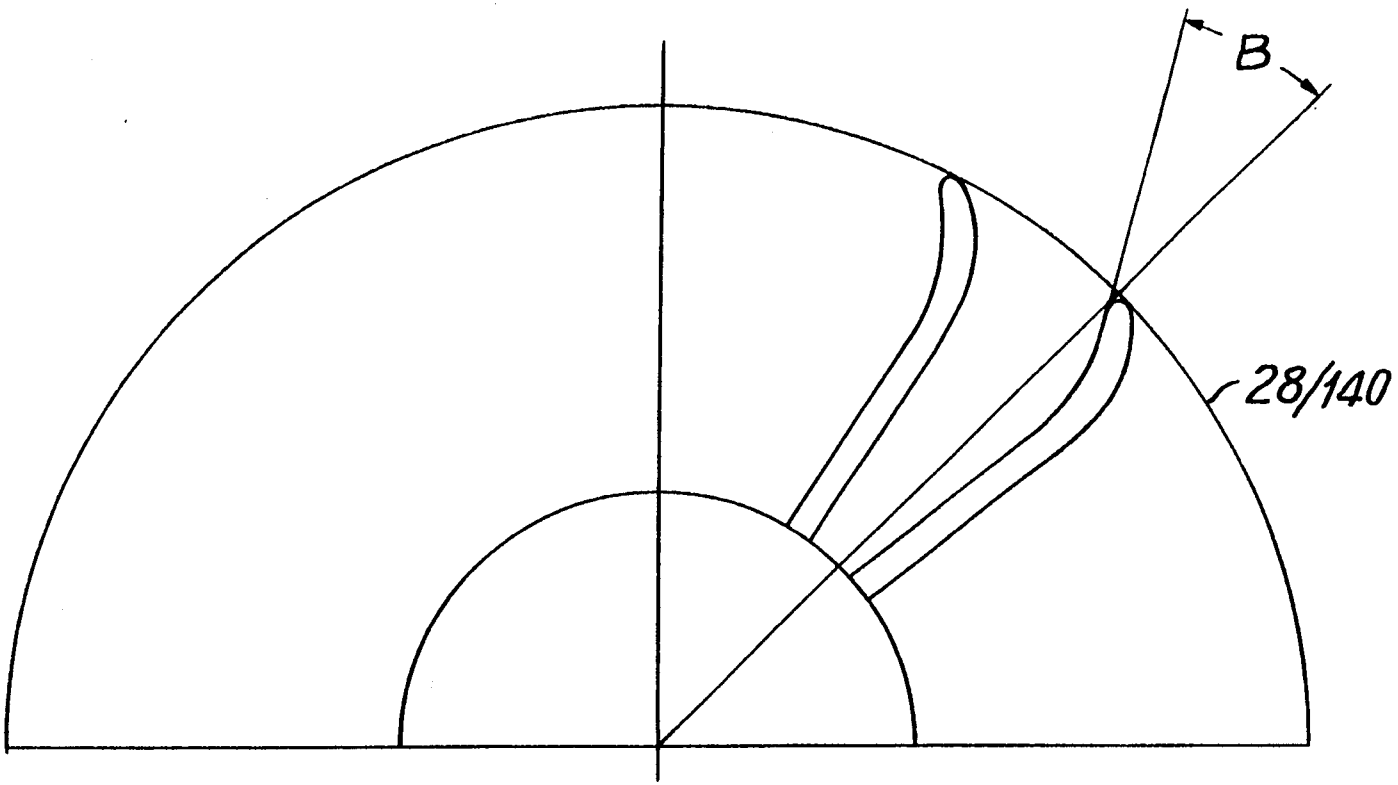

FIG. 18 is a simplified view of a portion of a liquid ring pump rotor taken generally along the line 2—2 in FIG. 1 which is useful in explaining another aspect of the invention.

DETAILED DESCRIPTION OF THE PREFERRED EMBODIMENTS

Some features of this invention are applicable to liquid ring pumps having either pressurized liquid or compressed gas as the bearing fluid for the rotating liner. Other features of the invention are of interest primarily or exclusively when the rotating liner bearing fluid is compressed gas. The features discussed first are among those applicable to pumps having either liquid or gas as the liner bearing fluid.

An illustrative liquid ring pump 10 having a rotating liner 34 is shown in FIG. 1 (which is substantially the same as the right-hand portion of FIG. 1 in commonly assigned, co-pending patent application Ser. No. 07/875,297). Pump 10 includes a stationary housing 20 having a hollow, substantially cylindrical main body 30. Rotor 28 is mounted on shaft 12 for rotation with the shaft about a shaft axis which is laterally offset from the central longitudinal axis of main body 30. The rotation of shaft 12 is powered by motor 13. A hollow, substantially cylindrical liner 34 is disposed inside main body 30. The outer cylindrical surface of liner 34 is radially spaced from the inner cylindrical surface of main body 30 by an annular clearance 35. A quantity of pumping liquid (e.g., water; not shown) is maintained in main body 30 so that when shaft 12 rotates rotor 28, the axially and radially extending blades of rotor 28 engage the pumping liquid and form it into a recirculating hollow ring inside main body 30. Because main body 30 is eccentric to rotor 28, this liquid ring is also eccentric to the rotor. The outer surface of the liquid ring engages the inner surface of liner 34 and causes the liner to rotate at a substantial fraction of the velocity of rotation of the liquid ring. A bearing fluid (e.g., a pressurized liquid such as water or a compressed gas such as compressed air) is forced into clearance 35 (e.g., from bearing fluid pump 33) via substantially annular chamber 36 and circumferentially and axially spaced apertures 38 in order to provide a fluid bearing for supporting liner 34 relative to main body 30. The above-described rotation of liner 34 with the liquid ring reduces fluid friction losses in the pump by reducing the amount of recirculating liquid ring surface which is in contact with stationary pump surfaces. This reduces the power requirements and increases the operating efficiency of the pump.

Gas to be pumped ("compressed") by the pump is supplied to the spaces ("chambers") between circumferentially adjacent rotor blades on one circumferential side of the pump via intake conduits 24 and inlet apertures 26, the latter being disposed in port members 22 which are part of the stationary structure of the pump. Inlet apertures 26 communicate with rotor chambers which are effectively increasing in size in the direction of rotor rotation because the inner surface of the liquid ring which forms one boundary of these chambers is receding from the shaft axis on this side of the pump due to the eccentricity of the liquid ring relative to the shaft axis. Accordingly, these chambers of increasing size pull in the gas to be pumped. After thus receiving gas to be pumped in the intake or suction zone of the pump, each rotor chamber moves around to the compression zone of the pump where the chamber decreases in size due to motion of the inner surface of the liquid ring toward the rotor axis. The gas in the chamber is thereby compressed, and the compressed gas is discharged from the rotor via outlet apertures 32 and discharge conduit 40.

One problem that may be encountered in designing, building, and operating pumps of the type shown in FIG. 1 (as well as the other pumps with rotating liners shown and described herein) is that the gas pressure differential from one circumferential side of the pump to the other tends to push liner 34 toward housing main body 30 in one radial direction. This could cause liner 34 to contact main body 30 at one location, thereby slowing down and possibly even stopping the rotation of the liner. This problem may arise with either liquid or compressed gas as the liner bearing fluid in clearance 35, but it is potentially more severe with gas as the bearing fluid because the use of gas typically dictates the use of a smaller clearance 35.

In addition to possibly allowing liner 34 to contact housing main body 30 on one circumferential side of the pump, the above-described radial shift of liner 34 tends to open up clearance 35 on the other circumferential side of the pump. This may permit a wasteful increase in liner bearing fluid flow on the latter side of the pump, especially when the bearing fluid is gas.

Figure 2:
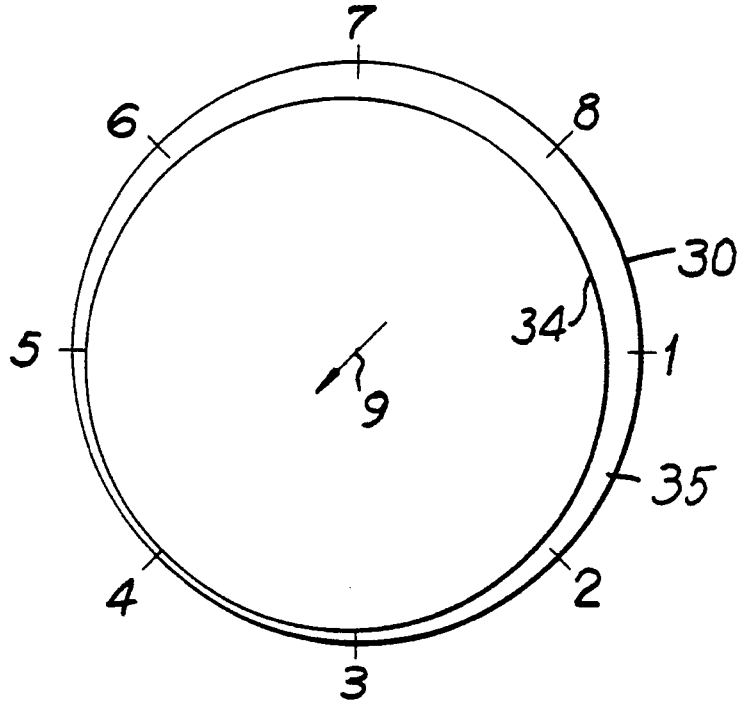
FIG. 2 is a simplified sectional view taken along the line 2—2 in FIG. 1.

The above-described problem is depicted in FIG. 2 which shows a conventional pattern of rotating liner bearing fluid supply orifices 1–8 (identified by generic reference number 38 in FIG. 1) in relation to stationary outer housing 30 and inner rotating liner 34. Orifices 1–8 are equally spaced around the circumference of housing 30. The clearance 35 between the liner 34 and housing 30 is exaggerated to more clearly illustrate the displacement of the liner due to the load 9 resulting from the pumped gas pressure differential from one circumferential side of the pump to the other. In particular, the load 9 on liner 34 is approximately equal to the gas pressure differential times the projected area of the liner (the "projected area of the liner" being the diameter of the liner times its axial length). The direction of load 9 shown in FIG. 2 is typical of pump designs which place the "land" (i.e., the point at which the outer tips of the rotor blades are closest to the housing) at an angle 45 degrees from the bottom of the housing. The flow rate and delivery pressure of the bearing fluid for rotating liner 34 affect the proper operation of the rotating liner and the overall efficiency of the pump. Both of these parameters are dependent on the magnitude of load 9.

Figure 3:
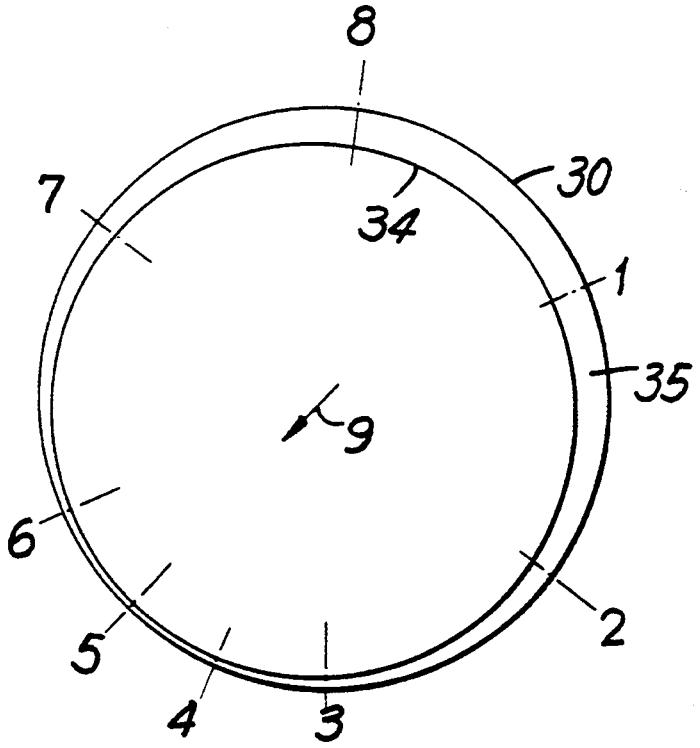
FIG. 3 is a view similar to FIG. 2 showing an illustrative modification in accordance with this invention.

In accordance with this invention, the ability of the bearing fluid (whether pressurized liquid or compressed gas, but especially in the case of compressed gas) to support liner 34 in rotation can be improved by concentrating more of orifices 1–8 in the loaded region as shown, for example, in FIG. 3. In the illustrative example shown in FIG. 3 a concentration of bearing fluid supply orifices 3, 4, 5, and 6 is located in the loaded sector. Remaining orifices 1, 2, 7, and 8 are spaced out evenly and more widely over the remaining sector of the pump. Thus, the spacing between adjacent orifices in the loaded sector is substantially less than the spacing between adjacent orifices elsewhere around the pump. In other words, there are more bearing fluid supply orifices per unit area of liner surface in the loaded sector of the pump than in the remaining unloaded sector. This puts more of the bearing fluid where it is most needed to support the load on liner 34. The bearing fluid is therefore used more effectively to support the liner. The bearing fluid flow, which is delivered at constant pressure through the orifices, is reduced by the close clearance between liner 34 and housing 30 in the loaded sector. Accordingly, for the same or even less bearing fluid flow a higher load can be supported.

Figure 4:
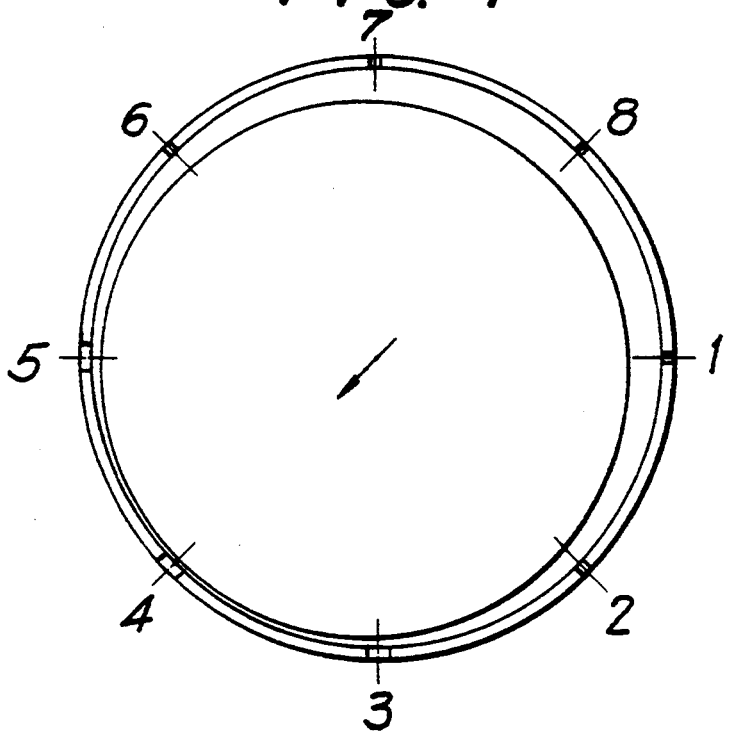
FIG. 4 is another view similar to FIG. 2 showing another illustrative modification in accordance with this invention.

As an alternative, illustrated by FIG. 4, the orifice size can be varied to achieve more efficient support for liner 34. As shown in FIG. 4, orifices 3, 4, and 5 in the load bearing sector are larger than the remaining orifices. This has an effect similar to increasing the number or density of orifices in the load bearing sector as described above in connection with FIG. 3. Again, more bearing fluid is introduced per unit area of liner surface in the loaded sector of the pump than is introduced in the remaining unloaded sector.

Figure 5:
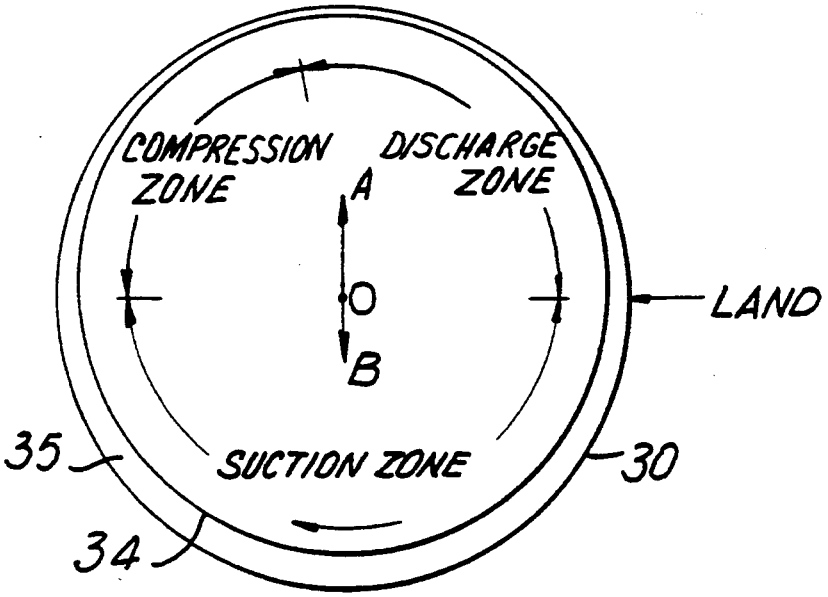
FIG. 5 is still another view similar to FIG. 2 showing still another illustrative modification in accordance with this invention.

As an alternative or addition to techniques of the type shown in FIGS. 3 and 4, savings in bearing fluid flow can be obtained by orienting the pump design so that the pressure differential offsets the weight of the liner as shown in FIG. 5. The compression and discharge strokes of the pump are oriented in the top two quadrants. This directs the load due to the pumped gas pressure differential upward as shown by vector OA. Offsetting this load is the downward weight of the liner (vector OB) and the weight of the liquid ring (not shown) in the liner.

Figure 6:
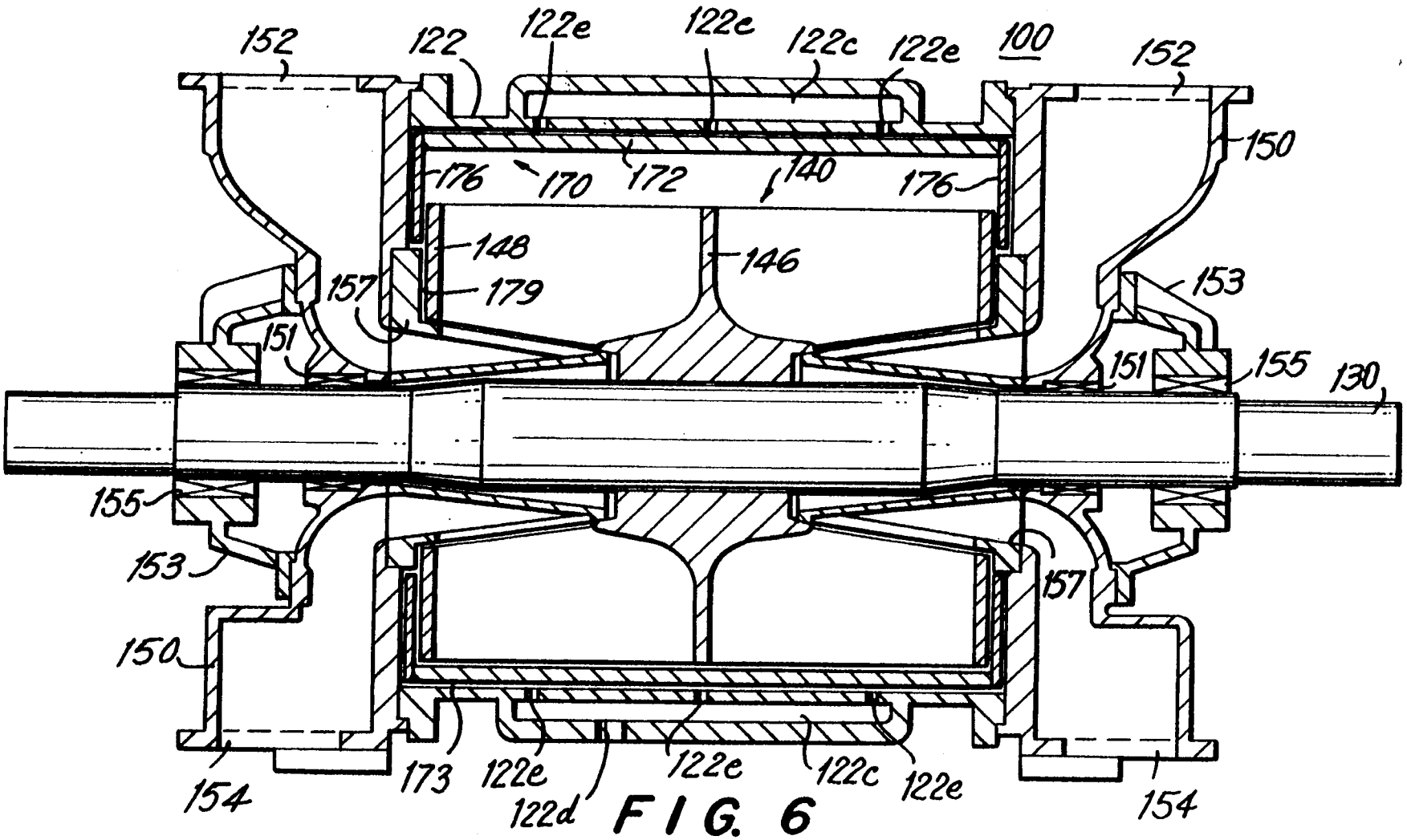
FIG. 6 is a simplified elevational view of another illustrative liquid ring pump which can be constructed and/or operated in accordance with the principles of this invention.

When compressed gas is used as the bearing fluid which supports liner 34 for rotation, it may be important to reduce or substantially eliminate escape of this gas into the working space of the pump. End plates of the type shown in Haavik U.S. Pat. No. 5,100,300 on one or both ends of the liner can be very helpful, either alone or in combination with other structures described below, in reducing or eliminating the escape or liner bearing gas into the working space of the pump. FIG. 6 herein (which is similar to FIG. 9 in U.S. Pat. No. 5,100,300) illustrates end plates 176 on both ends of rotating liner 170 for helping to prevent the escape of liner bearing gas from annular clearance 173 into the working space of pump 100. Although the parts of pump 100 are described in detail in U.S. Pat. No. 5,100,300, they are briefly reviewed here for completeness. Rotor 140 is mounted on shaft 130 for rotation about a shaft axis which is eccentric to the central longitudinal axis of hollow, substantially cylindrical, stationary housing 122. Rotor 140 includes a toroidal end shroud 148 at each of its axial ends, and an annular center shroud 146 at its axial midpoint. Rotatable liner 170 includes a hollow, substantially cylindrical main body 172 and a toroidal cover plate 176 partly closing each end of that main body. A quantity of pumping liquid (not shown) is maintained in liner 170 and housing 122 to form the liquid ring in the manner described above in connection with FIG. 1. Gas to be pumped ("compressed") is admitted to the pump via passageways 152 in head members 150 and via connecting passageways in hollow, frustoconical "cone" members 157. After compression, the gas is discharged from the pump via other passageways (e.g., 154) in cone and head members 157 and 150. Elements 151, 153, and 155 support shaft 130 for rotation.

In accordance with the present invention, compressed gas (e.g., compressed air) for use as a bearing fluid for supporting liner 180 for rotation is introduced into the pump via aperture **122*d*. This compressed gas is distributed annularly around the pump via passageway 122*c*. From passageway 122*c* the compressed gas enters annular clearance 173 via orifices 122*e* which are distributed axially along and circumferentially about the pump. The compressed gas thus introduced into clearance 173 supports liner 170 for rotation relative to housing 122 at a velocity which may be a large fraction of the velocity of the liquid ring. In particular, with lower viscosity compressed gas rather than higher viscosity liquid as the liner bearing fluid, liner 170 tends to rotate at a velocity which is much closer to the velocity of the liquid ring which impels that rotation. For example, with gas as the bearing fluid, liner 170 may rotate at approximately 80% of the rotor blade tip speed. This substantially improves the efficiency of the pump as compared to when liquid is used as the liner bearing fluid. End plates 176 help reduce the rate at which the compressed gas escapes from the axial ends of clearance 173 into the working space of the pump. End plates 176 also help to strengthen liner 170 and ensure that main body 172 remains cylindrical and therefore free to rotate in housing 122. This benefit of end plates 176 may be especially important when compressed gas is used as the liner bearing fluid because clearance 173 is then typically smaller than when the liquid is used for the liner bearing. In particular, when compressed gas is used as the liner bearing fluid, the thickness of clearance 173** in the radial direction may be only about 0.01 to about 0.10 percent of the outer diameter of the liner. By way of comparison, when water is used as the liner bearing fluid, a typical clearance thickness may be in the range from about 0.06 to about 0.15 percent of the outer diameter of the liner.

To further reduce the escape of compressed gas liner bearing fluid into the working space of the pump, means may be provided as shown, for example, in FIG. 7 to capture the compressed gas before it escapes into the working space and to remove it from the pump. In the illustrative embodiment shown in FIG. 7, an annular channel 220 is provided in head member 150 adjacent an axial end of clearance 173. (If desired, the other axial end of the pump can be constructed identically.) Annular channel 220 is in annular communication with the adjacent axial end of clearance 173. Accordingly, compressed gas escaping from the axial end of clearance 173 flows into annular channel 220 and is conveyed out of the pump via conduit 221. Conduit 221 may discharge into main discharge conduit 154 of the pump (preferably via check valve 222 as shown in FIG. 7), or conduit 221 may be extended and/or relocated to provide a completely separate exit from the pump. Compressed air collected by channel 220 and discharged from the pump via conduit 221 is thereby prevented from escaping from clearance 173 into the working space of the pump where it might interfere with the efficiency and/or capacity of the pump.

Figure 8:
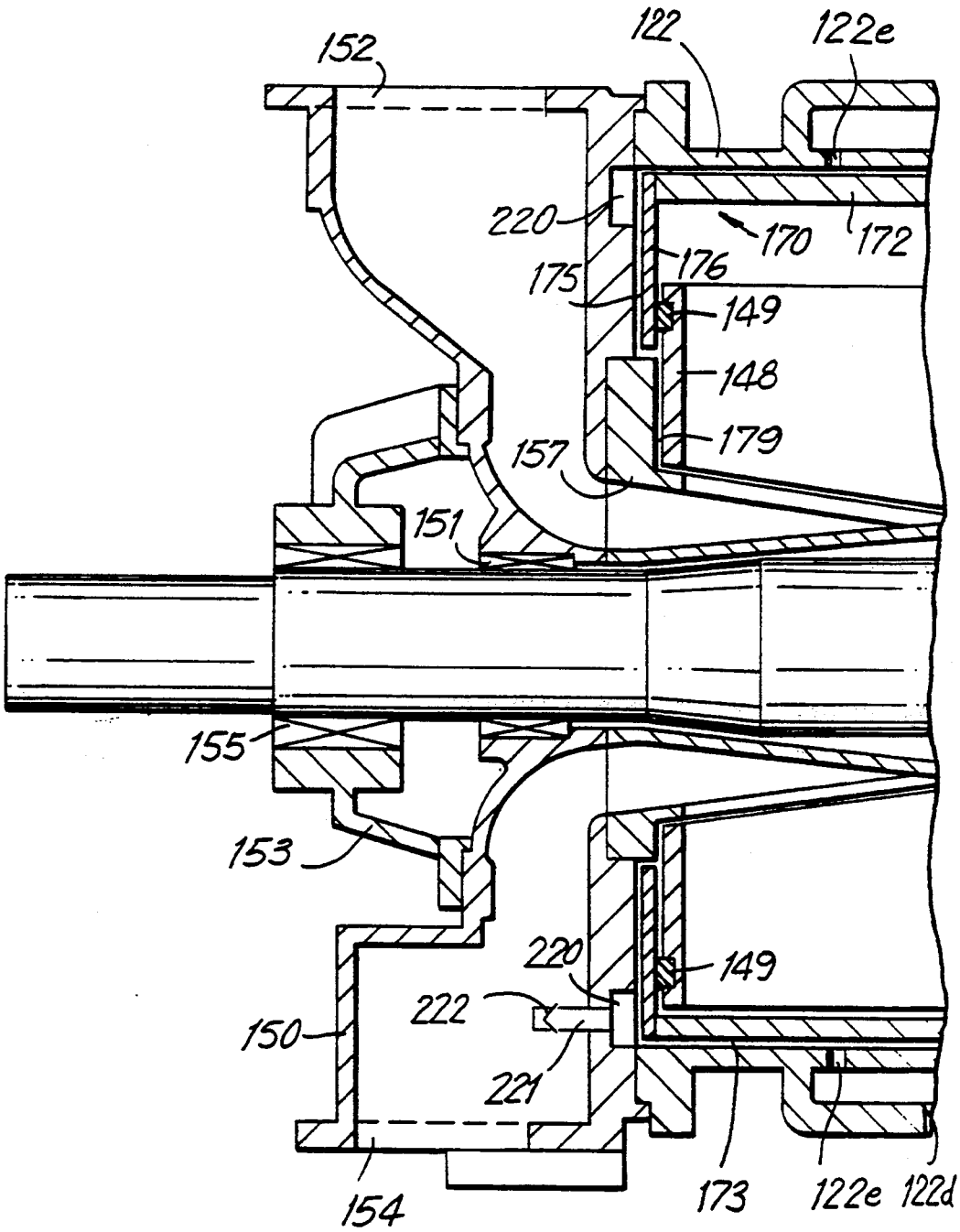

As an alternative or addition to channel 220 for collecting compressed gas leaving clearance 173, one or more seals may be provided for preventing or at least substantially reducing the escape of the compressed gas into the working space of the pump. In the illustrative embodiment shown in FIG. 8, for example, annular seal 149 is provided between rotor end shroud 148 and liner end plate 176. (If desired, the other axial end of the pump can be constructed identically.) Although FIG. 8 shows seal 149 mounted in rotor shroud 148 and bearing on liner end plate 176, it will be understood that the seal could be alternatively mounted in end plate 176 for bearing on shroud 148. With compressed air as the liner bearing fluid, liner 170 rotates at speeds close to the rotor speed. The main drag component of seal 149 is therefore due to relative movement of the sealed structures in the radial direction. Seal 149 slides back and forth between the inner and outer diameters of liner end plate 148. Also, the surfaces on which seal 149 slides are wetted with pumping liquid. Because of the low relative velocities and the low coefficient of friction, the power loss due to the seal drag is very low.

A possible alternative location for a seal to prevent or at least substantially reduce the escape of compressed gas liner bearing fluid into the working space of the pump is shown in FIG. 9. In FIG. 9 annular seal 177 is disposed between the innermost surface of end plate 176 and a radially outwardly facing surface of cone 157. (Again, the other end of the pump may be constructed similarly if desired.) Seal 177 seals the clearance between the stationary end structure of the pump and the inside diameter of liner end plate 176. In this location, seal 177 could operate with a running clearance between the stationary and rotating surfaces. As such, seal 177 might consist of simply a close running fit between the two metallic surfaces.

When compressed gas is used as the liner bearing fluid, it can be important not only to prevent the compressed gas from escaping into the working space of the pump, but also to prevent a solid liquid film from forming in the toroidal clearance 175 between each liner end plate 176 and the adjacent stationary end structure of the pump. The formation of such a solid liquid film increases the drag on the outer end walls of the liner, especially with the liner rotating at close to rotor speed. Annular channel 220 in any of FIGS. 7–9 may provide drainage of liquid from clearance 175. Alternatively, annular channel 220 may be located radially beyond the outside diameter of liner end plate 176 as shown in FIG. 10. In this location channel 220 may more readily receive liquid thrown radially out from toroidal clearance 175. FIG. 10 also illustrates the possibility that channel 220 may be drained to atmospheric pressure via conduit 221. Whether the arrangement shown in FIGS. 7–9 or the arrangement shown in FIG. 10 is used, any liquid which escapes from the inside of the rotor/liner structure is spun off by the end surfaces of the liner. This liquid collects in annular channel 220 where it mixes with the compressed gas discharging from the adjacent axial end of annular clearance 173. The resulting gas/liquid mixture discharges from the pump via conduit 221, either separately as shown in FIG. 10 or via the normal air/water discharge conduit 154 of the pump as shown in FIGS. 7–9.

Venting of the end surfaces of liner 170 as shown in any of FIGS. 7–10 also prevents any significant buildup of axial thrust on the liner. Each end of the liner is at discharge or atmospheric pressure. Any axial thrust in this design would have to be generated from an internal axial pressure differential, which is generally minimal, assuming that both liner end plates 176 are of the same size. Because axial thrust is generally relatively low, it may not be necessary to provide any additional structure for holding the axial position of the liner. Alternatively, the axial position of the liner may be held by seals such as seals 149 in FIG. 8. As still another alternative, hydrostatic bearings like those shown at 29 in FIG. 5 of U.S. Pat. No. 5,100,300 or in FIG. 11 herein may be used to hold the axial position of liner 170 in some cases. As shown in FIG. 11, a typical hydrostatic bearing pad 180 is disposed on head member 150 for operation on the axial end of liner 170 to help keep the liner axially spaced from the head member. Several similar bearing pads may be distributed to act on each end of the liner. Each such bearing pad is supplied with a bearing fluid via conduit 182. This bearing fluid may be either liquid or compressed gas. If liquid is used, the design and placement of pads 180 is preferably such as to prevent any overall buildup of liquid in clearance 175. Use of compressed gas for bearing pads 180 is most preferred from the standpoint of minimizing drag on the liner. However, the use of liquid in these pads may also be acceptable. The inclusion of hydrostatic bearing pads such as 180 to maintain the axial position of liner 170 may also help reduce load on and wear of seals such as 149 in FIG. 8 if such seals are provided.

Maintenance of a close internal clearance between the rotor and liner end walls helps minimize the influx of liner bearing gas leakage in vacuum pump applications. An important factor in minimizing degradation of performance due to inflow of gas leakage at higher vacuums is the internal flow of liquid in the liner-rotor clearance area. The flow of liquid tends to migrate from the high pressure side to the low pressure side, flooding the clearance area and sealing that area from liner bearing gas influx. It may also be important to provide continuous clean liquid flushing of the clearances adjacent the ends of the liner so that no foreign matter becomes caught between the ends of the rotor and the liner or the stationary cone flanges. This is especially important in applications such as supplying vacuum for papermaking machines where the pump (operating as a vacuum pump) may have to handle considerable carryover liquid from the paper machine containing large quantities of paper fibers, fabric fibers, fines, and other impurities.

If desired, additional measures can be taken to prevent liner bearing gas influx and promote continuous flushing by introducing sealing liquid (e.g., pressurized fresh liquid ring liquid) to regions such as annular clearance 179 in any of FIGS. 6–10. In FIG. 12, for example, clearance 179 is fed with sealing liquid via conduit 190 and (optional) annular channel 192 which communicates with clearance 179. As an alternative to separate conduit 190, clearance 179 could be supplied with sealing liquid from the normal cone seal passage as shown, for example, in FIG. 13. As shown in that FIG., passage 200 is the normal cone seal conduit in the head which communicates with passage 201 in the cone. Opening 202 is a tapping for supplying fresh liquid to passages 200 and 201. Internal conduit 203 communicates with end clearance region 179. The sealing liquid taken from a relatively clean source seals the tip clearance of the cone and also seals and flushes end clearance 179. The flow split is controlled by the size of conduit 203. The flow from conduit 203 (or channel 192 in FIG. 12) travels radially outward into the liquid ring. Depending on operating pressure, some of this flow may be forced through and help seal clearance 205, which is the radial clearance between liner end 176 and stationary member 157. Note that the use of sealing liquid as described above also reduces the reliance on the integrity of physical seals (e.g., 149 in FIG. 8 and 177 in FIG. 9) for good performance, if such physical seals are provided.

Although (as has been noted) the best performance may be achieved by operating the rotating liner with a gas envelope on all the external surfaces of the liner, in some applications flooding the clearances 175 outside the ends of the liner with fresh sealing liquid might be the preferred way of sealing the liner-rotor clearance from liner bearing gas leakage and/or providing needed flushing of clearances 175. In pump designs in which the length of the liner is long relative to the diameter, the adverse impact on efficiency of using liquid instead of gas in clearances 175 may not be very great. FIG. 14 therefore shows an alternative embodiment of the invention in which typical clearance 175 is flooded with fresh sealing liquid supplied from annular channel 194 and conduit 196. In this mode of operation the excess sealing liquid is discharged from clearance 175 in the manner described above (e.g., via channel 220 and conduit 221).

As an alternative to supplying sealing liquid to clearance 175 via separate conduit 196 as shown in FIG. 14, FIG. 15 shows supply of sealing liquid to clearance 175 from the normal cone seal conduit 200 in head 150. Conduit 210 admits sealing liquid to annular channel 211 from conduit 200. Accordingly, channel 211 is flooded with sealing liquid and helps seal clearance 205 from gas leakage, especially when the pump is operated as a vacuum pump.

As discussed above in connection with FIG. 11, fixing the axial position of the liner is important so that the liner does not contact the ends of the rotor. This axial fixing should be accomplished without placing excessive drag on the liner. FIG. 16 shows a modification of FIG. 15 which can be used to help attain this objective. As shown in FIG. 16 the outer diameter of channel 211 defines a region of close clearance 212 with liner end 176. Farther out radially the axial clearance 213 is relatively large. The annular band of close clearance maintains the axial position of the drum. This region is lubricated by sealing liquid from channel 211. Water is sufficient for this purpose because the axial load tends to be small. The majority of the liquid from channel 211 flows inward radially to seal clearance 205 and to flush clean the internal clearances. The remainder of the liquid from channel 211 flows out radially. The large clearance 213 prevents an accumulation of liquid in that region which could exert an excessive fluid drag on end 176. The liquid mixes with the gas in channel 220 and is discharged from the casing as described above in connection with similar channels 220. Optionally, seal 214, in slight rubbing contact with end 176, provides an additional barrier to leakage.

The top speed of a liquid ring pump is limited by such factors as the pump wear rate, the rate of cavitation attack, and the economies of operating the pump. Because efficiency (measured, for example, in terms of cubic feet of gas pumped per minute per horsepower required to operate the pump) tends to decline substantially with increased rotor tip speed in conventional pumps, a point is typically reached where it is more economical to select a larger, slower speed pump than to run a smaller pump faster. A significant advantage of the gas supported rotating liner is an increase in the potential speed range of the vacuum pump or compressor. FIG. 17 shows, for various pump operating speeds, the efficiency of a standard liquid ring vacuum pump compared to the efficiency of a similarly sized pump with an air supported rotating liner. FIG. 17 is for pumps operating at vacuums of 20 inches of mercury, and shows the efficiency E and rotor blade tip speed V of each pump related to a common reference efficiency $E_o$ and a common reference speed $V_o$. (The power required to supply the compressed air for the rotating liner is not accounted for in FIG. 17, but that would not significantly alter the conclusions.) As can be seen, the normal speed ratio range of a conventional vacuum pump (curve 250) is from somewhat below 0.5 to about 0.75 to 0.80. In contrast, a pump with an air supported rotating liner (curve 260) running with a speed ratio as high as 1.20 has efficiency greater than the standard pump at top speed. Therefore, pumps with gas supported rotating liners can be made smaller and run faster for the same capacity at increased efficiencies. Vacuum pump installations in paper mills and other industries can thus be made smaller, an important factor in view of ever-increasing airflow requirements.

The hydraulic wear of parts tends to increase exponentially with speed, as does the risk of cavitation attack. The gas supported liner of a properly operating vacuum pump operates at around 80% of the rotor speed. Therefore, the speed of the liquid ring relative to the drum wall is approximately 20% of the rotor speed, or about 24 feet per second relative velocity if the rotor speed is 120 feet per second. Because the standard pump ring speed relative to the stationary body may be as high as 75 to 80 feet per second, a large reduction in hydraulic wear of the wetted inner surface of the gas supported liner can be expected as compared to the wear in a conventional pump body.

An additional significant advantage is that faster running speed reduces the cost of the motors and ancillary equipment (e.g., couplings, guards, starter controls, etc.) needed to drive the pump.

In connection with liquid ring pumps having gas supported rotating liners, it has been determined that the rotor blade leading edge angle has a significant effect on pump performance. As shown in FIG. 18, the leading edge angle B is defined by the angle between a line drawn tangent to the leading edge surface at the outer periphery of the blade and a radial line which intersects the first line at the blade outer diameter. The interaction of the rotor blade and the liquid ring on the intake and discharge strokes is a very complex phenomenon. In general terms, it can be stated that the blade angle is an important parameter which determines the absolute velocity of the liquid ring outside the rotor periphery. A larger angle generates a higher absolute ring velocity, which in conventional pumps is needed in order to achieve practical pumping compression ratios. With gas supported rotating liners the fluid drag is significantly reduced. Accordingly the absolute ring velocity does not have to be as high to achieve the same compression work in comparison to a conventional pump. The blade angle can therefore be reduced in a pump with a gas supported rotating liner to lower the absolute velocity and achieve greater reduction in fluid losses. Normally the angle B in a standard pump is greater than 25 degrees. It has been discovered that in a pump with an air supported rotating liner, a blade angle B of 20 degrees or less operates well with significantly improved efficiency.

The compressed gas flow requirement for supporting the rotating liner in a liquid ring pump is influenced by the load on the liner and the projected area of the liner (i.e., the diameter of the liner times its axial length). For example, the compressed gas flow requirement may range from approximately 2 to 14 standard cubic feet per minute (SCFM) per square foot of projected liner area for air supplied at a minimum of about 40 psig. Other factors influencing gas flow requirements are the liner-to-housing clearance and the sizes and arrangement of the orifices supplying compressed gas to the clearance.

For some applications, the relatively simple construction shown in FIG. 1 may be suitable. This construction has a simple rotating liner with no end plates and no seals at the axial ends of clearance 35. The gas which supports the liner for rotation flows around the ends of the liner and enters the liquid ring. This gas travels radially inwardly due to its light weight relative to liquid in the centrifugal field of acceleration. At least part of the gas flows toward the inlet side of the pump where it expands to the inlet pressure and displaces useful pumping volume. All of the gas is ultimately discharged from the pump through the normal discharge ports 32.

The pump construction of FIG. 1 may be practical with compressed air as the liner bearing fluid for vacuum pumps operating at low vacuum in which the expansion of the liner supporting gas would be small. This pump construction may also be practical for compressors having low compression ratio. For these applications, the expanded flow rate of compressed gas into the liquid ring would be small relative to the overall pump capacity. This construction does not require complicated end seals because it is desired to have the gas flow around the ends of the liner.

It will be understood that the foregoing is merely illustrative of the principles of the invention, and that various modifications can be made by those skilled in the art without departing from the scope and spirit of the invention. For example, the pumps shown in the accompanying drawings are double-ended pumps with "conical" (actually frustoconical) port members. However, the principles of the invention are equally applicable to liquid ring pumps having many other well known configurations such as single-ended pumps, and pumps with flat or cylindrical port members.

The invention claimed is:

1. A liquid ring pump comprising:

an annular container for containing a quantity of pumping liquid;

a rotor disposed in said container, said rotor being rotatable about a central longitudinal axis of said rotor in order to engage said pumping liquid and form it into a recirculating annular ring inside said container, said container being rotatable about a container axis about which said container is annular and which is parallel to said central longitudinal axis of said rotor; and a pressurized gas bearing for at least partly supporting said container for rotation about said container axis.

2. A liquid ring pump comprising:

a hollow, substantially cylindrical housing member;

a hollow, substantially cylindrical liner member disposed in said housing member substantially concentric with said housing member, the diameter of the outer surface of said liner member being slightly smaller than the diameter of the inner surface of said housing member so that there is an annular clearance between the outer surface of said liner member and the inner surface of said housing member;

a rotor disposed in said liner member for rotation about a rotor axis which is parallel to but laterally spaced from the central longitudinal axis of said liner member, said rotor having a plurality of radially and axially extending blades spaced from one another about said rotor axis;

means for maintaining a quantity of pumping liquid between said liner member and said rotor;

means for rotating said rotor about said rotor axis so that said blades engage said pumping liquid and form it into a recirculating ring inside and substantially concentric with said liner member, said ring cooperating with said rotor to provide chambers for pumping gas supplied to the pump for pumping; and means for introducing compressed gas into said annular clearance so that said compressed gas substantially fills said annular clearance and supports said liner member for rotation relative to said housing member about said central longitudinal axis, said liner member being thus rotated by contact with said recirculating annular ring of pumping liquid.

3. The apparatus defined in claim 2 wherein said means for introducing compressed gas comprises a plurality of apertures through said housing member and circumferentially spaced from one another around said housing member, a portion of said compressed gas being introduced into said clearance via each of said apertures.

4. The apparatus defined in claim 2 wherein said pump has an arcuate segment in which the average pressure of the gas in said chambers while inside said arcuate segment is substantially higher than the average pressure of the gas in said chambers while outside of said arcuate segment, and wherein said pump is oriented with said central longitudinal axis substantially horizontal and said arcuate segment at the top of said pump.

5. The apparatus defined in claim 2 wherein the width of said annular clearance in the radial direction is in the range from about 0.01 to about 0.10 percent of the diameter of the outer surface of said liner member.

6. The apparatus defined in claim 2 wherein the radially outer portion of each blade is inclined in the direction of rotor rotation by an angle of approximately 20° or less, said angle being measured between the leading surface of said radially outer blade portion and a radius of said rotor which intercepts the radially outermost part of said leading surface.

7. The apparatus defined in claim 2 wherein said compressed gas is supplied to said pump at a minimum of about 40 psig.

8. The apparatus defined in claim 2 wherein said compressed gas is supplied to said pump at a rate of approximately 2 to 14 SCFM per square foot of projected liner member area.

9. The apparatus defined in claim 2 wherein said pump has an arcuate segment in which the average pressure of the gas in said chambers while inside said arcuate segment is substantially higher than the average pressure of the gas in said chambers while outside of said arcuate segment, and wherein said means for introducing compressed gas introduces more of said compressed gas per unit of liner surface area in said arcuate segment than it introduces per unit of liner surface area outside of said arcuate segment.

10. The apparatus defined in claim 9 wherein said means for introducing compressed gas comprises a plurality of apertures through said housing member and circumferentially spaced from one another around said housing member, a portion of said compressed gas being introduced into said clearance via each of said apertures.

11. The apparatus defined in claim 10 wherein the aggregate size of said apertures per unit area of the inner surface of said housing member in said arcuate segment is substantially greater than the aggregate size of said apertures per unit area of the inner surface of said housing member outside of said arcuate segment.

12. The apparatus defined in claim 11 wherein the average cross sectional area of said apertures in said arcuate segment is substantially greater than the average cross sectional area of said apertures outside of said arcuate segment.

13. The apparatus defined in claim 11 wherein the average spacing between adjacent apertures in said arcuate segment is substantially less than the average spacing between adjacent apertures outside of said arcuate segment.

* * * * *